US008814906B2

(12) United States Patent
Baksinski

(10) Patent No.: US 8,814,906 B2
(45) Date of Patent: Aug. 26, 2014

(54) LUMBAR LORDOSIS MAINTENANCE SYSTEM AND METHOD

(76) Inventor: Gregory Baksinski, Homer Glen, IL (US)

( * ) Notice: Subject to any disclaimer, the term of this patent is extended or adjusted under 35 U.S.C. 154(b) by 534 days.

(21) Appl. No.: 13/178,912

(22) Filed: Jul. 8, 2011

(65) Prior Publication Data

US 2012/0245635 A1 Sep. 27, 2012

Related U.S. Application Data

(60) Provisional application No. 61/466,930, filed on Mar. 24, 2011.

(51) Int. Cl.

| | |
|---|---|
| ***A61F 5/00*** | (2006.01) |
| ***A47C 7/46*** | (2006.01) |
| ***A47C 16/02*** | (2006.01) |

(52) U.S. Cl.

CPC ..... *A47C 7/46* (2013.01); *A47C 16/025* (2013.01)

USPC .. 606/237; 606/241; 297/452.32; 297/423.44

(58) Field of Classification Search

CPC ..... A47C 7/16; A47C 7/02; A47C 7/40; A47C 7/50; A47C 16/02; A47C 16/025

USPC ..... 601/23, 24, 27, 29, 31, 32, 33, 35; 606/237, 241; 297/261, 338, 452.29, 297/452.3, 423.41, 423.45, 423.46, 452.32, 297/423.44; 128/845

See application file for complete search history.

(56) References Cited

U.S. PATENT DOCUMENTS

| | | | | |
|---|---|---|---|---|
| 3,606,458 A * | 9/1971 | Attinger | ..... | 297/423.45 |
| 4,773,106 A | 9/1988 | Toso et al. | | |
| 5,001,791 A | 3/1991 | Toso | | |
| 5,083,554 A | 1/1992 | Toso | | |
| 5,235,714 A | 8/1993 | Toso | | |
| 5,238,296 A * | 8/1993 | Paul | ..... | 297/423.43 |
| 5,348,377 A * | 9/1994 | Grosch | ..... | 297/423.45 |
| 5,375,279 A | 12/1994 | Toso | | |

(Continued)

OTHER PUBLICATIONS

Journal: "Sitting Biomechanics Part 1: Review of the Literature," Harrison DD, Harrison SO, Croft AC, et al., J Manipulative Physiol. Ther. 1999;22(9):594-609.

Journal: "The Prediction of Lumbar Spine Geometry: Method Development and Validation," Campbell-Kyureghan, et al., Clin Biomech (Bristol, Avon). Jun. 2005;20(5):455-64.

Journal: "Electromyographic activity imbalances between back muscles: An assessment of measurement properties," Lariviere, et al, J. of Rehab. R&D, Mar./Apr. 2005; vol. 42, No. 2, pp. 235-250, 2005.

Journal: "Surface Electromyography in the Assessment of Changes in Paraspinal Muscle Activity Associated with Vertebral Subluxation: A Review," Kent, J. of Vert. Subluxatiuon Rsch., vol. 1 No. 3, 1997.

Journal: "Lumbar Spine and Pelvic Posture Between Standing and Sitting: A Radiological Investigation Including Reliability and Repeatability of the Lumbar Lordosis Measure," DE Cavalho, et al., J. Manipulative and Physiological Therapeutics, Jan. 2010; vol. 33, No. 1, 48-55.

*Primary Examiner* — Quang D Thanh

(74) *Attorney, Agent, or Firm* — The Thompson Law Office, P.C.; Lawrence E. Thompson, Esq.

(57) ABSTRACT

Disclosed herein is a new and improved system and method for maintaining and improving the function of the human back. A first embodiment of the method may include the steps of sitting in a lumbar support chair for a first period of time with the lumbar portion of the back in a reclined neutral lordosis, placing the feet on an elevated foot support, and standing erect with the assistance of a rod for a second period of time. The lumbar support chair may include a sacral depression, a lumbar protrusion, a thoracic recession, a raised dorsal thigh support, a left thigh protrusion, and a right thigh protrusion. The elevated foot support may be capable of pivoting towards and away from the lumbar support chair and placing the feet on the elevated support may result in the knees being higher than the iliac crest.

11 Claims, 3 Drawing Sheets

(56) References Cited

U.S. PATENT DOCUMENTS

| | | | | |
|---|---|---|---|---|
| 5,607,202 | A | | 3/1997 | Toso et al. |
| 5,643,184 | A | | 7/1997 | Toso |
| 5,645,080 | A | | 7/1997 | Toso |
| 5,887,951 | A | | 3/1999 | Willingham |
| 6,132,342 | A | * | 10/2000 | McKinney et al. ..... 297/46 |
| 7,607,738 | B2 | | 10/2009 | Gregory et al. |
| 7,833,182 | B2 | | 11/2010 | Hughes |
| 7,878,996 | B2 | | 2/2011 | Smith, Jr. |

* cited by examiner

FIG. 1
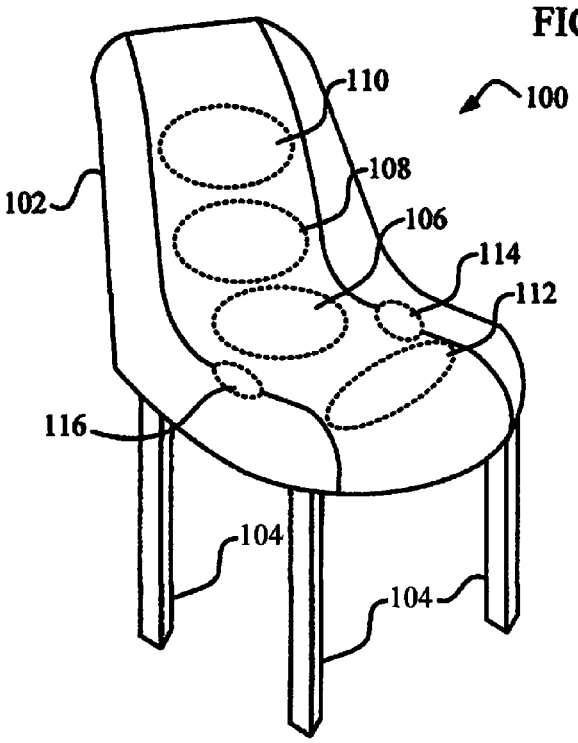
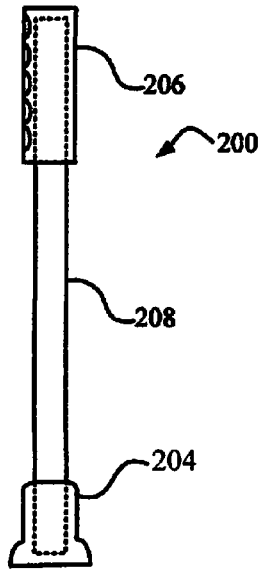
FIG. 2

LUMBAR LORDOSIS MAINTENANCE SYSTEM AND METHOD

CROSS-REFERENCE TO RELATED APPLICATION

This application claims the benefit of U.S. Provisional Application No. 61/466,930, filed Mar. 24, 2011.

BACKGROUND

1. Field

This invention is generally related to a system and a method for maintaining and improving the function of the human back.

2. Background

A principal aspect the present invention relates to a lumbar support device and methods of maintaining and improving the function of the human back using a lumbar support device to maintain a proper, or neutral, lumbar lordosis. In particular, the present invention relates to a lumbar support device for providing stabilization and alignment of a user's back, and methods of using the lumbar support device.

Mechanical back pain is a problem that affects a large proportion of the population at some point in their lives. The pain often occurs as a result of damage to the discs between the vertebrae in the spine. Damage to these discs can result in more pressure being applied to nerve roots, which leads to pain. As people get older, the discs lose hydration and tend to narrow, thus increasing the pressure on the nerve roots. In younger people, the fibers that form the outer walls of the intervertebral discs can become damaged, resulting in fissures in the outer walls of the discs. As the fibers break down, the gel-like substance contained within the disks leaks out, reducing the effectiveness of the discs and increasing the pressure on the surrounding nerves and ligaments. The resulting instability can reduce or block the range of movement and cause pain, weakness and sensory changes. These types of damage to the spine often occur gradually as a result of poor posture and excessive bending of the back.

As set forth by De Cavalho, et al., "Low back pain is one of the most perplexing musculoskeletal conditions affecting society. From epidemiologic studies, it has been determined that there is a 50% to 80% lifetime chance of developing low back pain. The 2002 National Health Information Survey (United States) indicates that back pain is the most reported type of pain and that 26.4% of the people completing the survey experienced recent low back pain (within the last 3 months). In any given year, 25% to 45% of the population will be affected with a back condition of some kind. [P]revalence rates for back pain have remained fairly consistent since the 1970s. The extensive effects of this condition on the population are reflected in the workforce with low back pain being the leading cause of worker's compensation claims and the fourth most costly physical health condition affecting American businesses. In a review article examining the economic costs associated with back pain between 1997 and 2007, [the authors] found that the total cost for back pain in the United States could be estimated as low as $19.6 to as high as $624.8 billion (if ratios of indirect to direct costs from European countries is applied to US figures)." Lumbar Spine And Pelvic Posture Between Standing and Sitting: A Radiological Investigation Including Reliability and Repeatability Of The Lumbar Lordosis Measure," *J. Manipulative and Physiological Therapeutics*, Vol. 33, No. 1 (internal citations omitted; article incorporated herein).

At present, mechanical back pain, such as that described above, is often treated by prescribing drugs to the patient. However, although drugs may reduce the pain experienced by the patient and may reduce the inflammation, drugs do not address the underlying cause of the pain. Furthermore, surgery is sometimes used to address problems in the spine, for example, to remove a damaged segment and to fuse the neighboring vertebrae. Surgery, however, is expensive and invasive, and often does not provide a long lasting solution. Physical supports have also been tried. However, these physical support systems are either inconvenient or ineffective.

It is therefore desirable to provide a lumbar support device for providing stabilization and alignment of a user's back and a method for improving the function of the human back.

SUMMARY

Disclosed herein is a new and improved system and method for maintaining and improving the function of the human back. A first embodiment of the method may include the steps of sitting in a lumbar support chair for a first period of time with the lumbar portion of the back in a reclined neutral lordosis, placing the feet on an elevated foot support, and standing erect with the assistance of a rod for a second period of time. The lumbar support chair may include a sacral depression, a lumbar protrusion, a thoracic recession, a raised dorsal thigh support, a left thigh protrusion, and a right thigh protrusion. The elevated foot support may be capable of pivoting towards and away from the lumbar support chair and placing the feet on the elevated support may result in the knees being higher than the iliac crest.

Other systems, methods, aspects, features, embodiments and advantages of the system and method for maintaining and improving the function of the human back disclosed herein will be, or will become, apparent to one having ordinary skill in the art upon examination of the following drawings and detailed description. It is intended that all such additional systems, methods, aspects, features, embodiments and advantages be included within this description, and be within the scope of the accompanying claims.

BRIEF DESCRIPTION OF THE DRAWINGS

It is to be understood that the drawings are solely for purpose of illustration. Furthermore, the components in the figures are not necessarily to scale, emphasis instead being placed upon illustrating the principles of the system disclosed herein. In the figures, like reference numerals designate corresponding parts throughout the different views.

FIG. 1 illustrates an embodiment of a lumbar support chair portion of the system for maintaining and improving the function of the human back.

FIG. 2 illustrates an embodiment of a rod portion of the system for maintaining and improving the function of the human back.

DETAILED DESCRIPTION

Figure 3A:
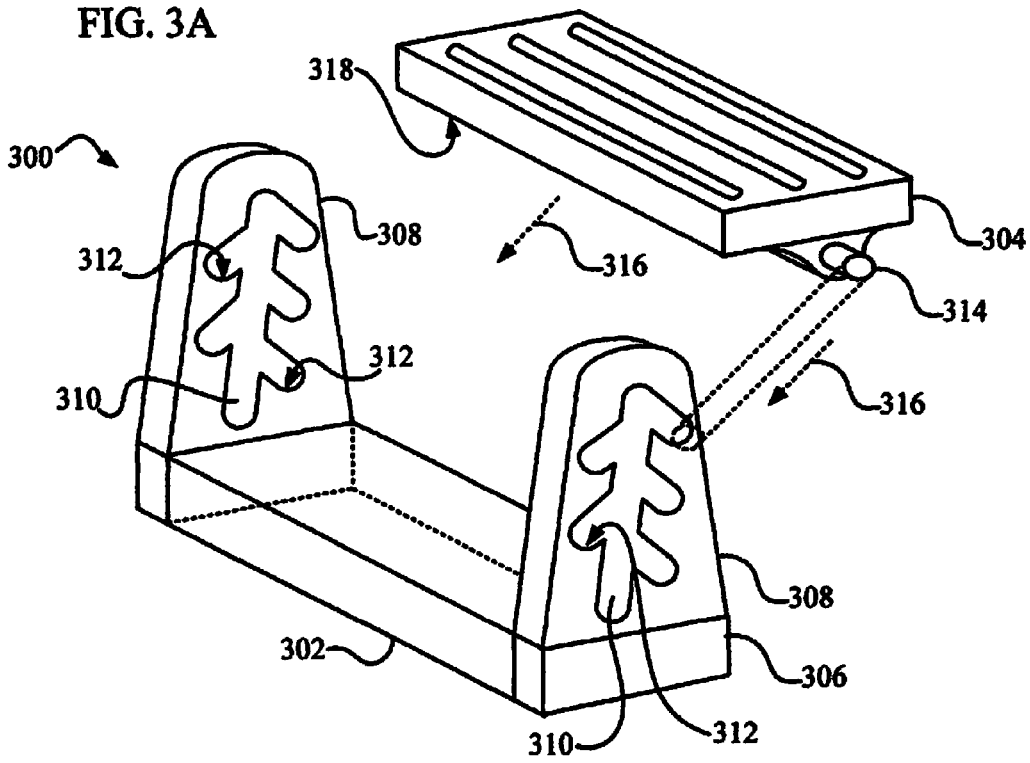
FIG. 3A illustrates a perspective view of an embodiment of an elevated foot support portion of the system for maintaining and improving the function of the human back, including a pivotable surface.

The following detailed description, which references to and incorporates the drawings, describes and illustrates one or more specific embodiments. These embodiments, offered not to limit but only to exemplify and teach, are shown and described in sufficient detail to enable those skilled in the art to practice what is claimed. Thus, for the sake of brevity, the description may omit certain information known to those of skill in the art.

FIG. 1 illustrates an exemplary embodiment of a lumbar support chair 100 of the current invention. The lumbar support chair 100 may include a seat 102 and one or more supports 104. The seat 102 may include a sacral depression 106, a lumbar protrusion 108, a thoracic recession 110, a raised dorsal thigh support 112, a left thigh protrusion 114, and a right thigh protrusion 116. The lumbar protrusion may be, for example, 3-5 centimeters. The supports 104, though illustrated as legs in FIG. 1, may also comprise a laterally rotatable pedestal and may also be height adjustable. The seat 102 may be, but is not limited to, a race seat such as, but not limited to, a pro high back seat, such as model 555-70250 available from JEGS High Performance of Delaware, Ohio, and a race car seat as available from Sterling Technologies, Inc. of Lake City, Pa.

FIG. 2 illustrates an exemplary embodiment of a rod 200 of the invention. The rod 200 may include a base foot 204 and a handle grip 206 mounted on opposing ends of a pole 208. The rod 200 may be used to push off of, as opposed to a device for leaning upon. The rod 200 may also be employed after sitting in the lumbar support chair 100 and may be employed while squeezing the gluteus muscles in order to emphasize an anterior flexion of the pelvis in order to facilitate a standing neutral lumbar lordosis.

FIG. 3A illustrates an exemplary embodiment of an elevated foot support 300 of the current invention. The elevated foot support 300 may include a base support 302 and a pivotable surface 304. The base support 302 may include a base 306 and a pair of vertical supports 308. The vertical supports 308 may include a tree-like void 310. The tree-like void 310 may include a plurality of axle support positions 312. The pivotable surface 304 may include an axle 314.

Figure 3B:
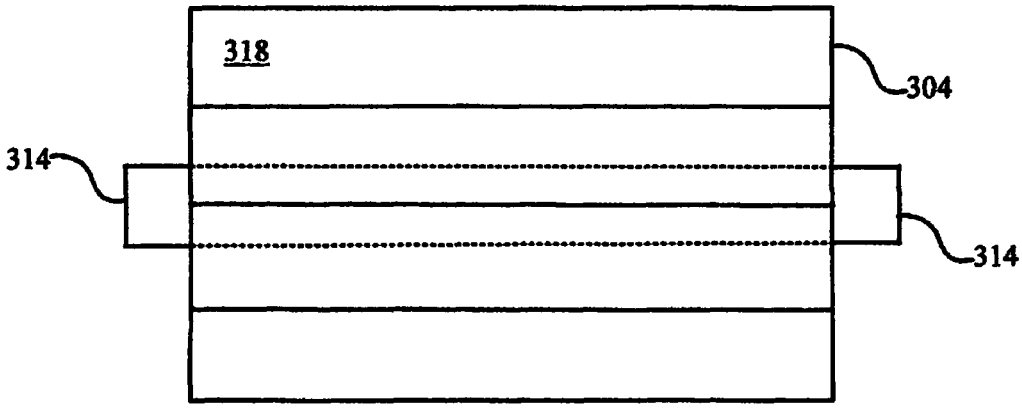
FIG. 3B illustrates a bottom view of the pivotable surface of FIG. 3A.

Though the base support 302 and the pivotable surface 304 are shown separated for illustrative purposes in FIG, 3A, it is contemplated that the pivotable surface 304 may be located (as illustrated by arrows 316) and movable within the tree-like void 310 such that the pivotable surface may be located, and relocated, to various axle support positions 312 in order to adjust the elevation of the pivotable surface 304. FIG. 3B illustrates the bottom side 318 of the pivotable surface 304 of FIG. 3A.

Figure 4:
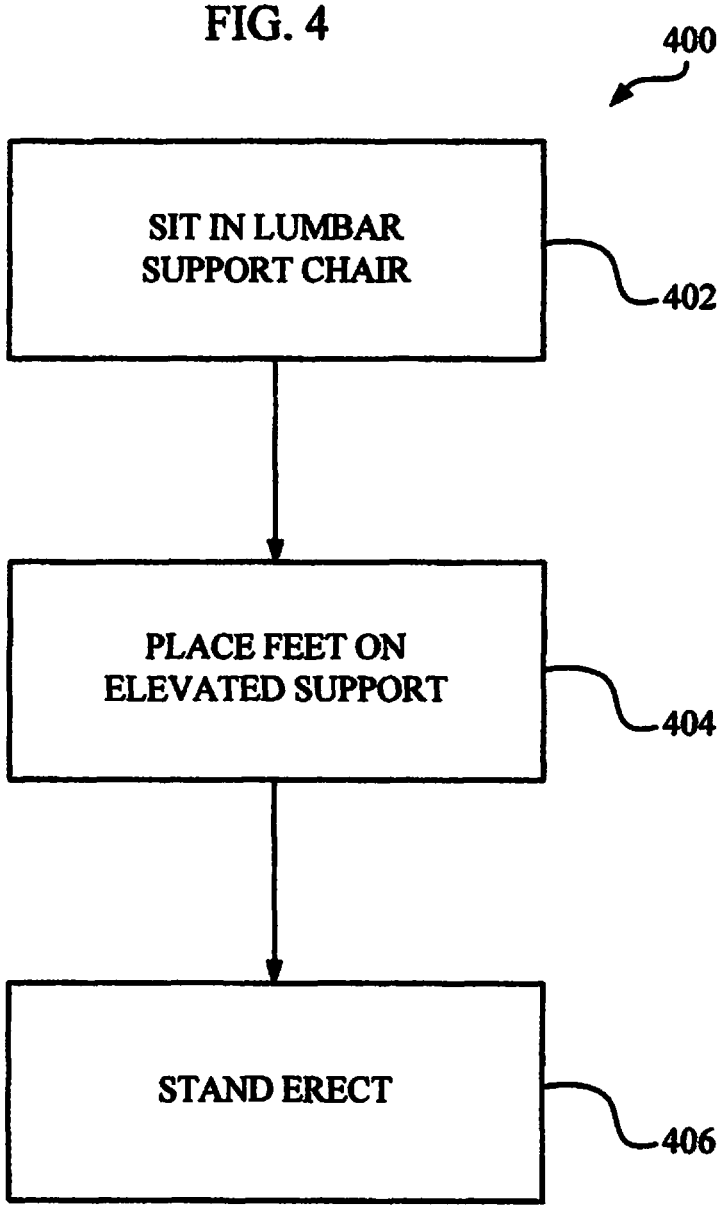
FIG. 4 is flow chart illustrating one embodiment of the method for maintaining and improving the function of the human back.

FIG. 4 is an exemplary flow chart 400 illustrating one embodiment of the method for maintaining and improving the function of the human back. A first step 402 may include sitting in a lumbar support chair, such as lumbar support chair 100, for a period of time with the lumbar portion of the vertebral column in a reclined neutral lordosis. While sitting, the configuration of the lumbar support chair, including the sacral depression 106, the left thigh protrusion 114, and the right thigh protrusion 116, tends to lock or secure the user into the correct sitting position as the user's backside makes contact with the lumbar support chair.

Lordosis, as is known to those skilled in the art, is an inward curvature of at least a portion of the vertebral column. A neutral lordosis, as is known to those having skill in the art, is when the vertical column is neither flexed nor extended. Those having skill in the art are familiar with methods for determining the neutral lumbar lordosis applicable to any particular individual. Imaging techniques, such as radiography, computer tomography, and magnetic resonance imaging have been used to determine the neutral lumbar lordosis applicable to any particular individual. Non-invasive techniques, such as but not limited to, determinations based on measures of trunk posture, for example, using an electrogoniometer, have also been used to determine the neutral lumbar lordosis applicable to any particular individual. Such measures are described in publications such as, "The Prediction of Lumbar Spine Geometry: Method Development and Validation," by Campbell-Kyureghan, et al., Clin Biomech (Bristol, Avon). 2005 June; 20 (5):455-64, which is incorporated herein. In addition, measures of an erect standing lumbar neutral lordosis may be derived from secondary anatomical measures, such as but not limited to, determining that the anterior superior iliac spines and the posterior superior iliac spines are on the same horizontal plane. The reclined neutral lordosis may be defined as a T12 to S1 Cobb angle of approximately 65 degrees.

The period of time in which the user may sit in a lumbar support chair, such as lumbar support chair 100, may be based upon a number of parameters particular to the user, but may also be for a predetermined time, such as, for example, ten minutes. The period of time the user may sit in the lumbar support chair may also be determined through electromyography. Electromyography may be employed to determine the electrical characteristics of the lower back muscles. One goal may include reducing the Electromyographic (EMG) reading for spinal muscles. Such EMG measuring methods are described by Lariviere, et al, in "Electromyographic activity imbalances between back muscles: An assessment of measurement properties," J. of Rehab. R&D, Vol. 42, No. 2, pgs. 235-250, 2005, and by Kent in "Surface Electromyography in the Assessment of Changes in Paraspinal Muscle Activity Associated with Vertebral Subluxation: A Review," J. of Vert. Subluxation Rsch., Vol. 1 no. 3, 1997, which are incorporated herein. Further EMG measuring methods are described in Harrison D D, Harrison S O, Croft A C, et al., "Sitting Biomechanics Part 1: Review Of The Literature," J Manipulative Physiol. Ther. 1999; 22 (9):594-609, which is incorporated herein.

Another step 404 may include placing the feet on an elevated foot support, such as elevated foot support 300, while sitting. The elevated foot support 300 may be capable of pivoting towards and away from the support chair. The placing of the feet on the elevated foot support may result in the knees being higher than the hip joints or the iliac crest. The elevated foot support may allow for rotation of the ankles, adjustment of the height of the knees, and adjustment of the distance between chair and foot rest.

The method may also include the step 406 of standing erect with the assistance of a rod, such as rod 200, for a period of time sufficient to stretch the muscles associated with the lumbar spine to allow for an erect neutral lumbar lordosis. The erect neutral lordosis may also be defined as a T12 to S1 Cobb angle of approximately 65 degrees. The muscles of concern associated with the lumbar spine include the psoas majores, piriformis, iliocostalis lumborum, tensor fascia, erector spinae, and gluteus maximus. Factors that may prevent a neutral lordosis include abnormal pressure from muscles associated with the lumbar spine.

Maintaining a period of reclining neutral lumbar lordosis minimizes the stresses upon the lumbar region and trains the muscles to seek the same posture during activity and may lead to a reduction in regional lumbar pain. Some muscles associated with maintaining the neutral lumbar lordosis may be strengthened due to the differential exertion required to maintain the reclined neutral lumbar lordosis. A simulated standing neutral lumbar lordosis while reclined, without the stress loads imposed by supporting the body erect, may lead to such benefits. Thus, a goal is to maintain an anterior pelvic rotation without the spinal load (anterior from the perspective of the top of the pelvis) imposed when erect.

The system and method described herein may provide support for pelvic anterior rotation in the sagital plane in both anterior and posterior motion with additional support for lateral translation and adjustable knee height. The system and method may include the prevention of assuming a posture that may defeat a neutral lordosis.

The word "exemplary" is used herein to mean "serving as an example, instance, or illustration." Any embodiment or variant described herein as "exemplary" is not necessarily to be construed as preferred or advantageous over other embodiments or variants. All of the embodiments and variants described in this description are exemplary embodiments and variants provided to enable persons skilled in the art to make and use the invention, and not necessarily to limit the scope of legal protection afforded the appended claims.

The above description of the disclosed embodiments is provided to enable any person skilled in the art to make or use that which is defined by the appended claims. The following claims are not intended to be limited to the disclosed embodiments. Other embodiments and modifications will readily occur to those of ordinary skill in the art in view of these teachings. Therefore, the following claims are intended to cover all such embodiments and modifications when viewed in conjunction with the above specification and accompanying drawings.

What is claimed is:

1. A method for maintaining and improving a user's back, the user having feet, knees, and an iliac crest, the method comprising the steps of:

sitting in a lumbar support chair for a first period of time with a lumbar portion of the back in a reclined neutral lordosis, the lumbar support chair including a sacral depression, a lumbar protrusion, a thoracic recession, a raised dorsal thigh support, a left thigh protrusion, and a right thigh protrusion;

while sitting, placing the feet on an elevated foot support, the elevated foot support capable of pivoting towards and away from the lumbar support chair; and standing erect with the assistance of a rod for a second period of time;

wherein the placing the feet on the elevated foot support results in the knees being higher than the iliac crest.

2. The method of claim 1, wherein the first period of time is at least until a measurement of the electrical activity of a muscle associated with the lumbar spine reaches a minimum.

3. The method of claim 1, wherein the first period of time is at least 10 minutes.

4. The method of claim 1, wherein the reclined neutral lordosis includes a T12 to S1 Cobb angle of 65 degrees, plus or minus 3 degrees.

5. The method of claim 1, wherein the reclined neutral lordosis is within 10% of a normal range of the user's standing lordosis angle.

6. The method of claim 1, wherein the reclined neutral lordosis is a lordosis angle between 50 degrees and 60 degrees.

7. The method of claim 1, wherein the elevated foot support is configured to allow for vertical adjustment of a pivotable surface.

8. The method of claim 1, wherein a distance between elevated foot support and the lumbar support chair is adjustable.

9. The method of claim 1, wherein the step of standing erect includes tensing the user's gluteus maximus muscles.

10. The method of claim 1, wherein the second period of time is sufficient to stretch muscles associated with the lumbar spine to allow for an erect neutral lordosis.

11. A system for maintaining and improving a human back, the system comprising:

a lumbar support chair, the lumbar support chair including a sacral depression, a lumbar protrusion, a thoracic recession, a raised dorsal thigh support, a left thigh protrusion, and a right thigh protrusion;

an elevated foot support placed in front of the lumbar support chair, the elevated foot support having a base support, a pivotable surface, a base, a pair of vertical supports having a void having a plurality of axle support positions; and a rod, the rod having a base foot and a handle grip and the rod placed within reach of the lumbar support chair.

* * * * *